US012543825B2

(12) United States Patent
Dulude

(10) Patent No.: US 12,543,825 B2
(45) Date of Patent: Feb. 10, 2026

(54) STRAIN-HARDENED SAFETY TOE FOR FOOTWEAR

(71) Applicant: TBL Licensing LLC, Stratham, NH (US)

(72) Inventor: Ryan Dulude, Lee, NH (US)

(73) Assignee: TBL Licensing LLC, Stratham, NH (US)

( * ) Notice: Subject to any disclaimer, the term of this patent is extended or adjusted under 35 U.S.C. 154(b) by 272 days.

(21) Appl. No.: 18/196,653

(22) Filed: May 12, 2023

(65) Prior Publication Data

US 2023/0276895 A1 Sep. 7, 2023

Related U.S. Application Data

(62) Division of application No. 17/078,199, filed on Oct. 23, 2020, now Pat. No. 11,684,114.

(51) Int. Cl.

| | |
|---|---|
| ***A43B 23/08*** | (2006.01) |
| ***C21D 1/02*** | (2006.01) |
| ***C21D 1/26*** | (2006.01) |
| *A43B 7/32* | (2006.01) |
| *A43D 11/12* | (2006.01) |

(52) U.S. Cl.

CPC ..... *A43B 23/082* (2013.01); *C21D 1/02* (2013.01); *C21D 1/26* (2013.01); *A43B 7/32* (2013.01); *A43D 11/12* (2013.01)

(58) Field of Classification Search

CPC ..... A43B 23/082; C21D 1/02; C21D 1/26

See application file for complete search history.

(56) References Cited

U.S. PATENT DOCUMENTS

| | | | | |
|---|---|---|---|---|
| 2,079,237 A | | 5/1937 | Allard | |
| 2,091,223 A | | 8/1937 | Binder | |
| 2,151,554 A | * | 3/1939 | Josephson | A43B 23/082 36/77 R |
| 3,968,673 A | * | 7/1976 | Ryan | B21D 37/08 29/414 |

(Continued)

FOREIGN PATENT DOCUMENTS

| | | | |
|---|---|---|---|
| CN | 201042220 | Y | 4/2008 |
| DE | 202005009495 | U1 | 10/2005 |

(Continued)

OTHER PUBLICATIONS

Digges, Thomas G., Samuel J. Rosenberg, Glenn W. Geil. Heat Treatment and Properties of Iron and Steel. National Bureau of Standards Monograph 88. (Year: 1966).*

(Continued)

*Primary Examiner* — Tima M. McGuthry-Banks
(74) *Attorney, Agent, or Firm* — Lerner David LLP

(57) ABSTRACT

A protective device, in particular a safety toe cap, for use with an article of footwear is provided. A safety toe cap of the present technology includes one or more strain hardened portions configured to strengthen or reinforce sections of the safety toe cap against impact, particularly from above. The one or more strain hardened portions have increased strength in relation to adjacent non-strain hardened portions and therefore may maintain adequate protection of a user's toes and foot, while simultaneously allowing for lowered material use and a device with a lightweight, streamlined profile.

9 Claims, 10 Drawing Sheets

(56) References Cited

U.S. PATENT DOCUMENTS

| | | | | |
|---|---|---|---|---|
| 4,735,003 | A | 4/1988 | Dykeman | |
| 5,666,745 | A | 9/1997 | Harwood | |
| 5,809,666 | A | 9/1998 | Harwood | |
| 6,598,323 | B1 | 7/2003 | Gougelet et al. | |
| 7,062,868 | B2 | 6/2006 | Frulla | |
| 10,743,622 | B2 * | 8/2020 | Yeh | A43B 7/08 |
| 2004/0154779 | A1 | 8/2004 | Frulla | |
| 2006/0213086 | A1 | 9/2006 | Ching | |
| 2011/0185602 | A1 | 8/2011 | Kurth et al. | |
| 2016/0353843 | A1 | 12/2016 | Yeh | |
| 2017/0118967 | A1 | 5/2017 | Omura | |
| 2020/0170350 | A1 | 6/2020 | Benchoff et al. | |
| 2020/0259380 | A1 | 8/2020 | Ikemoto et al. | |
| 2020/0275727 | A1 | 9/2020 | Beltran | |

FOREIGN PATENT DOCUMENTS

| | | | |
|---|---|---|---|
| EP | 0239313 | B1 | 12/1992 |
| EP | 1514488 | A1 | 3/2005 |
| EP | 2286686 | A1 | 2/2011 |
| WO | 9719609 | A1 | 6/1997 |
| WO | 2014007818 | A1 | 1/2014 |
| WO | 2015015477 | A1 | 2/2015 |
| WO | 2021094898 | A1 | 5/2021 |

OTHER PUBLICATIONS

DE 202005009495 U1 machine translation (Year: 2005).*
Extended European Search Report issued in Appln. No. 21204111.5 dated Mar. 15, 2022 (3 pages).
Extended European Search Report including Written Opinion issued in Appln. No. 25173307.7 dated Sep. 12, 2025. 12. pgs.

* cited by examiner

STRAIN-HARDENED SAFETY TOE FOR FOOTWEAR

CROSS-REFERENCE TO RELATED APPLICATION

This application is a divisional of U.S. application Ser. No. 17/078,199, filed Oct. 23, 2020 (now U.S. Pat. No. 11,684,114), the disclosure of which is incorporated herein by reference.

FIELD OF THE INVENTION

The present invention relates to articles of footwear and methods of making the same, in particular protective articles of footwear having improved safety and protection of the toe and forefoot region while simultaneously maintaining a slim and lightweight profile.

BACKGROUND OF THE INVENTION

Protective footwear including protective devices for shielding the toe and forefoot region of the foot from injury are widely used in various sectors of the footwear industry. These protection devices may be referred to as toe caps, safety toes, safety toe caps, toe protectors, or steel toes and may be employed as independent devices or may be integrated into the shoe or other article of footwear. Common scenarios in which such protective devices may be necessary are in construction applications, in mining, or in other like fields where the foot may be susceptible to injury due to impact with extraneous objects (e.g., falling rocks, lumber, puncture via nails, etc.)

In order for the footwear to be designated as "protective footwear", certain types of safety footwear must satisfy particular requirements For instance, the American Society for Testing and Materials (ASTM) sets standards for protecting consumer's toes and metatarsal areas in "protective footwear" (e.g., as set forth in ASTM F2413-11). If a safety toe cap is used, it must meet certain impact resistance and compression resistance tests, indicating the toe cap can sufficiently protect a user's foot from injury.

In some cases, while the aforementioned protective devices may provide adequate protection from injury and satisfy ASTM standards, the amount and thickness of material necessary to do so may cause the protective device and footwear to be unduly heavy, bulky, and awkward for a user. A bulky device having a large profile may also be difficult to integrate into an article of footwear without significant alteration to the shape, structure, and aesthetic aspects of the footwear. In addition, a heavy protective device may be expensive to manufacture due to the high amount of metal or other protective material needed to manufacture a thick, heavy device. Other deficiencies not noted here also exist.

BRIEF SUMMARY OF THE INVENTION

A safety toe cap according to the present technology is adapted to provide adequate protection to a user's toe and forefoot region, while maintaining a lightweight, thin, and streamlined profile, so as to be comfortable for a user and easy to incorporate into an article of protective footwear. The safety toe cap of the present technology includes one or more strain hardened regions which provide increased strength with decreased mass, thickness, and material usage.

In particular, in some aspects, the present technology provides a protective toe cap for an article of footwear, comprising a hemi-dome shaped body adapted to cover a user's toes once incorporated into an article a footwear, and having opposing inner and outer surfaces, a forefoot side, a midfoot side, a medial side, and a lateral side, and further including at least one strain hardened portion and at least one non-strain hardened portion.

In an embodiment, in the protective toe cap according to the present technology, the at least one non-strain hardened portion has a yield strength of about 350 MPa to about 880 MPa. Further, the at least one non-strain hardened portion may have a yield strength of about 400 MPa to about 500 MPa. In some embodiments, the at least one strain hardened portion may have a yield strength which is increased by about 1% to about 2% with respect to a yield strength of the at least one non-strain hardened portion. In addition, the at least one strain hardened portion may have a hardness which is increased by about 2% to out 4% with respect to a hardness of the at least one non-strain hardened portion.

In some embodiments, the protective toe cap may have a thickness of no more than about 3.0 mm, while in alternative embodiments, the protective toe cap may have a thickness of no more than about 2.8 mm. Additionally, a thickness of the at least one strain hardened portion may be smaller than a thickness of the non-strain hardened portion by 0.2 mm to 1.0 mm.

In some aspects, the protective toe cap may be formed of a material comprising one or more of aluminum, steel, magnesium, titanium, or an alloy thereof. In one embodiment, the protective toe cap is formed of an aluminum alloy.

In some embodiments, the at least one strain hardened portion may be formed as a continuous channel in at least one of the inner and outer surface of the hemi-dome shaped body running from the medial side to the lateral side.

In some aspect, the at least one strain hardened portion comprises two to four strain hardened portions. In an embodiment, the at least one strain hardened portion is disposed nearer the midfoot side than the forefoot side. Further, the at least one strain hardened portion may be formed as a depression in at least one of the inner surface and the outer surface without a corresponding protrusion present on the opposing surface.

In addition, the present technology provides an article of footwear comprising an upper defining a cavity adapted to receive the foot of a user, wherein the upper is attached to an outsole, and a protective toe cap positioned adjacent a toe region of the footwear, the protective toe cap comprising a hemi-dome shaped body adapted to cover the user's toes, and having opposing inner and outer surfaces, a forefoot side, a midfoot side, a medial side, a lateral side, and a lower lip extending along a perimeter of the body configured to attach the protective toe cap to a sole portion of the article of footwear, the body further including at least one strain-hardened portion and at least one non-strain hardened portion.

The present technology further includes a method of manufacturing a protective toe cap, comprising: (i) providing a sheet of metal; (ii) providing a mold having first and second pressing surfaces, wherein at least one of the first and second pressing surfaces includes a protrusion; (iii) pressing the sheet of metal between the first and second pressing surfaces to produce a hemi-dome shaped body including at least one strain hardened portion formed by the protrusion; (iv) hardening the hemi-dome shaped body by heating to a first temperature within a range of about 500° C. to about 550° C. and maintaining the hemi-dome shaped body at the first temperature for a first period of 60 to 100 minutes to produce a hardened hemi-dome shaped body; and (v) tempering the hardened hemi-dome shaped body by heating to a second temperature within a range of about 150° C. to about 200° C. and maintaining the hardened hemi-dome shaped body at the second temperature for a second period of 10 to 20 hours to produce the protective toe cap.

In some embodiments, the sheet of metal comprises one or more of aluminum, steel, magnesium, or titanium, or an alloy thereof. Further, the pressing may be conducted at a temperature of no more than about room temperature.

DETAILED DESCRIPTION

In describing aspects of the present technology, specific terminology will be used for the sake of clarity. However, the technology is not intended to be limited to any specific terms used herein, and it is to be understood that each specific term includes all technical equivalents, which operate in a similar manner to accomplish a similar purpose.

As used in the present application, "length" means the longest dimension of any object or shape. As used in the present application, "width" means the shortest dimension of any object or shape existing in the same plane or surface as the length. "Thickness" means the remaining dimension of a three-dimensional object which is not the length or the width.

As used in the present application, "medial" means at, towards, near, or relating to the midline of the human body, i.e. as applied to a shoe as it would be oriented when it is situated on the foot of a wearer. As used in the present application, "lateral" means at, towards, near, or relating to the edge of an object, particularly an edge or end which is away from or opposite the midline (medial region) of the human body. When the terms "medial" and "lateral" are applied to a shoe or other wearable object, they describe portions of the object as they would be oriented when worn by a wearer.

As used in the present application, "strain hardened" means a material or portion of material which has been subjected to a mechanical process in which the material or portion of material has been worked beyond its elastic limit to cause plastic deformation, resulting in increased mechanical strength. Accordingly, the material or portion of material which is "strain hardened" has a higher yield strength and hardness than adjacent areas of the same material which are not "strain hardened".

The technology disclosed herein includes, in general, protective devices such as safety toe caps, various types of protective footwear including such protective devices, and methods of making the same. The safety toe caps of the present technology include one or more strain hardened portions to increase strength and impact resistance, while simultaneously minimizing weight and material usage. These safety toe caps may be utilized as separate protective devices or may be incorporated into an article of footwear.

Figure 1:
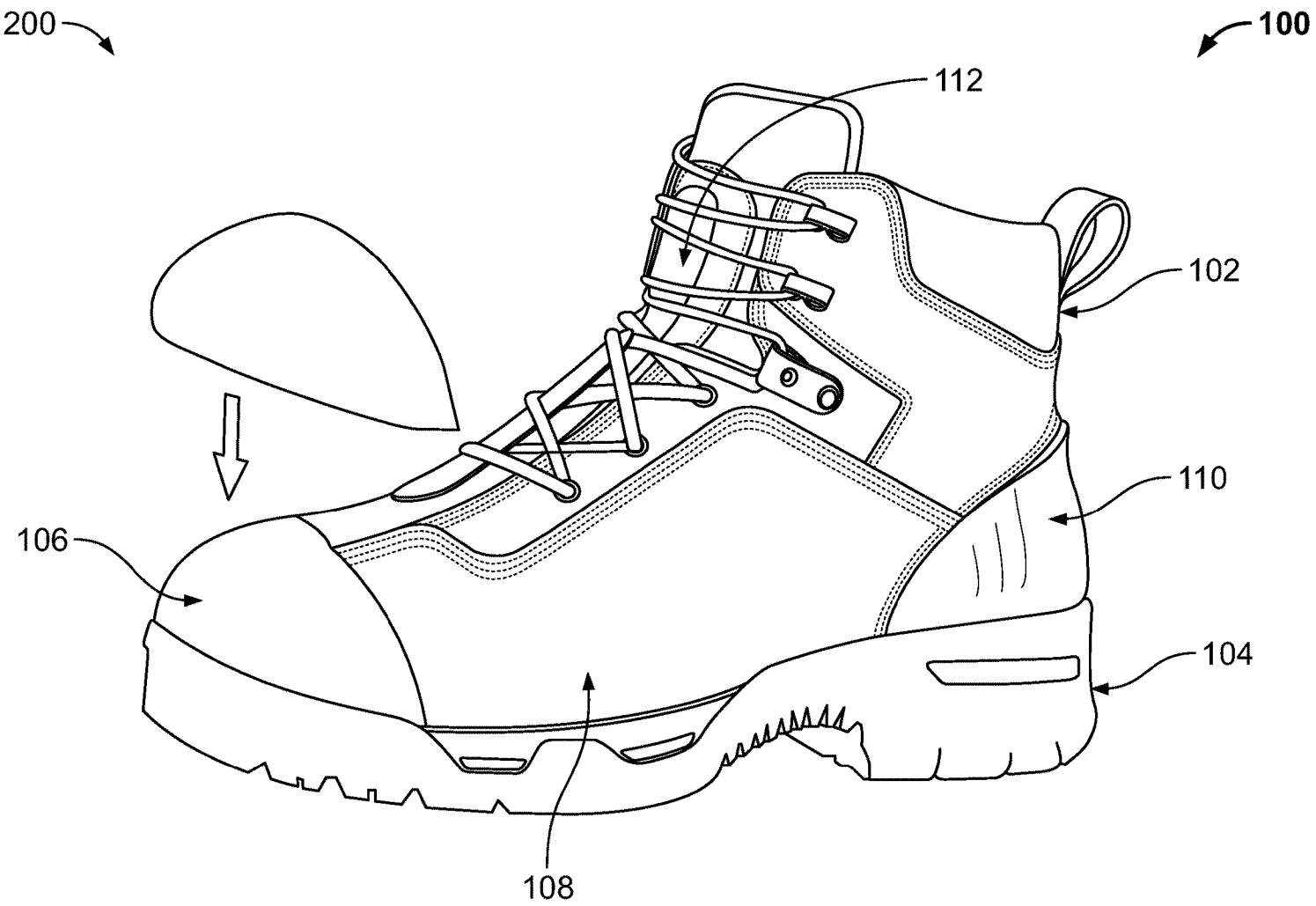
FIG. 1 is a diagrammatic view of a protective article of footwear and a safety toe cap according to aspects of the present technology.
Figure 2A:
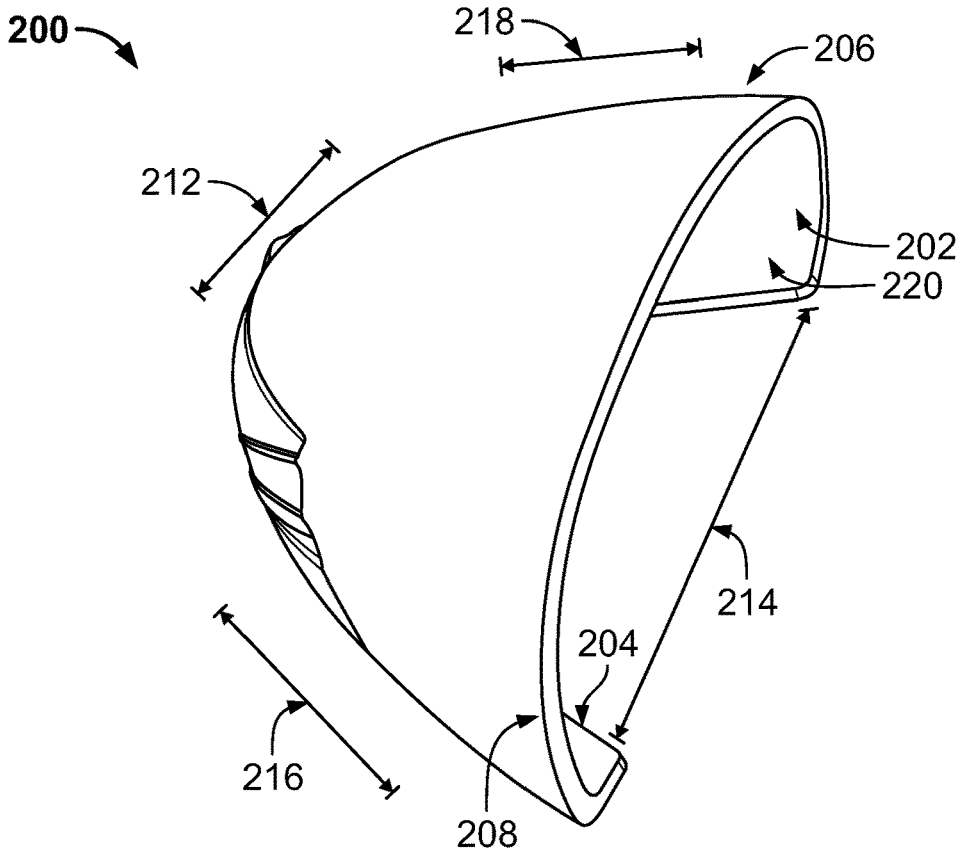
FIG. 2A is a perspective view of a safety toe cap according to an embodiment of the present technology.
Figure 2B:
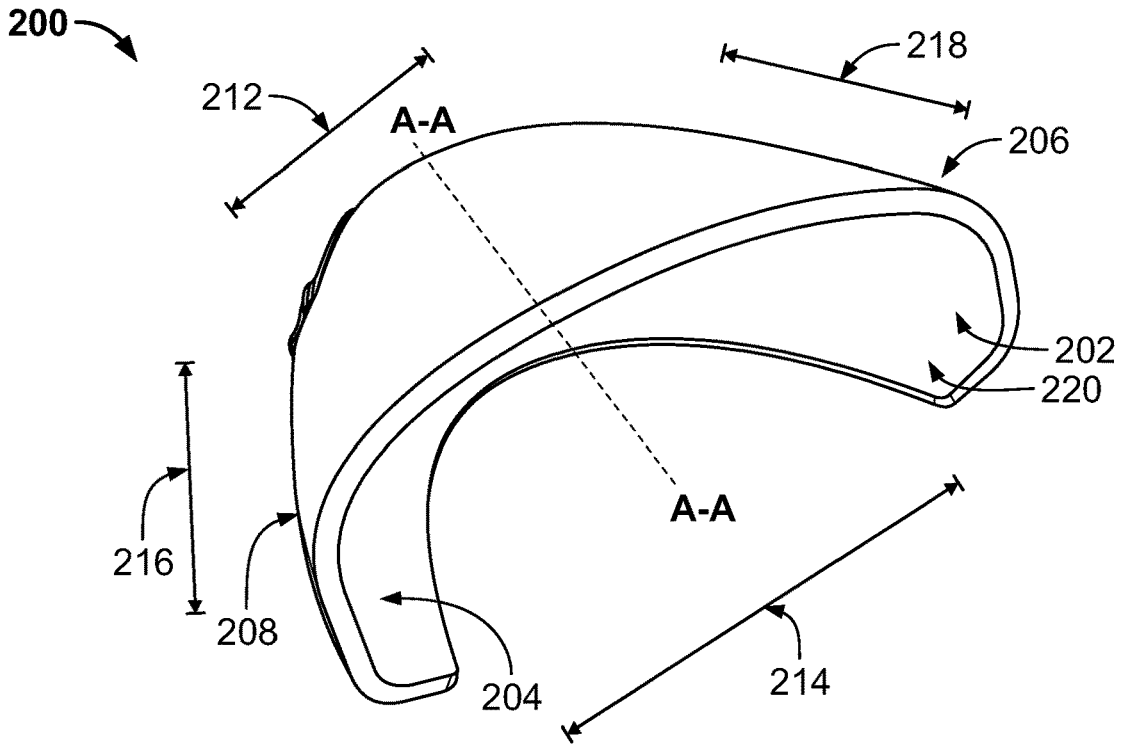
FIG. 2B is another perspective view of the safety toe cap of FIG. 2A.

For example, as shown in FIGS. 1, 2A, and 2B, protective footwear 100 may be provided with safety toe cap 200, which is shaped to fully cover a user's toes and provide protection therefor. Thus, safety toe cap 200 is shaped as a hemi-dome in some embodiments. Safety toe cap 200 includes an open underside 202 delimited by inner surface 204 and shaped and sized to accommodate a user's toes. Safety toe cap 200 also includes an opposing upper side 206 defined by an outer surface 208 which in some aspects is shaped to conform to and fit against the upper 102 of an article of protective footwear 100. In some embodiments, safety toe cap 200 also includes a lower lip 220 that extends around the perimeter of underside 202. Lip 220 may be positioned in an article of footwear 100 under a user's foot and be utilized for attaching safety toe cap 200 to such footwear.

Safety Toe Cap

As shown in FIGS. 2A-2B, safety toe cap 200 is shaped as a hemi-dome in some aspects. Safety toe cap 200 a forefoot side 212, a midfoot side 214, a medial side 216 and a lateral side 218. In some aspects, safety toe cap 200 is asymmetrical along longitudinal line A-A extending from forefoot side 212 to midfoot side 214. In particular, safety toe cap 200 may be slightly larger or longer on a medial side of line A-A than on a lateral side, so as to provide additional space for the big toe compared to the little toe. In alternative embodiments, safety toe cap 200 may be substantially symmetrical along a longitudinal line A-A running from forefoot side 212 to midfoot side 214, so that regions adjacent the medial and lateral sides are generally mirror images of one another. The safety toe cap 200 of the present technology includes one or more strain hardened portions 300 (FIG. 3A), as described in more detail below.

Safety toe cap 200 is composed of a metal or metal alloy material or any other material of sufficient strength to satisfy safety standards for protective footwear, such as ASTM F2413-11 or ASTM F2413-18. In particular, an appropriate material for safety toe cap 200, may have a yield strength of about 350 MPa to about 880 MPa, preferably about 400 MPa to about 700 MPa, and most preferably about 400 MPa to about 500 MPa, prior to strain hardening. In addition, an appropriate material for safety toe cap 200, may have a hardness of about 60 HRB to about 90 HRB, preferably about 70 HRB to about 90 HRB, and most preferably about 80 HRB to about 90 HRB, prior to strain hardening. Further, the material for safety toe cap 200, may have a density of about 2.5 g/cm$^3$ to about 8.1 g/cm$^3$, more preferably from about 2.5 g/cm$^3$ to about 5 g/cm$^3$, and most preferably from about 2.5 g/cm$^3$ to about 4.5 g/cm$^3$. When the toe cap material has properties within these ranges, it is capable of sufficiently resisting deformation and damage from impact so as to protect a user's toes, as well as having the advantage of providing a lighter weight toe cap which is more comfortable from the perspective of a user.

For example, safety toe cap 200 may be preferably formed of a material comprising one or more of aluminum, steel, magnesium, or titanium, or an alloy thereof. The material of safety toe cap 200 may further comprise additional alloying elements, such as carbon, zinc, magnesium, copper, silicon, iron, manganese, chromium, or any combination therein. In a preferred embodiment, safety toe cap 200 is formed of 7075 aluminum alloy (AA7075).

The safety toe cap 200 may have a thickness 302 (FIG. 3C) of no more than 3.0 mm, preferably no more than 2.8 mm, and most preferably no more than about 2.4 mm. In some embodiments, the safety toe cap 200 may satisfy the safety standards according to ASTM F2413-11 or ASTM F2413-18 even while having a relatively small thickness 302 such as less than 3.0 mm, less than 2.8 mm, or less than 2.4 mm. The safety toe cap 200 may be capable of maintaining adequate safety and resistance to impact due to the incorporation of one or more strain hardened portions 300. In contrast, safety toe caps of the prior art which lack strain hardened portions according to the present technology may require a greater thickness, such as at least 3.5 mm, in order to achieve the same safety standards, resulting in heavier and bulkier toe caps which require higher material use.

Strain Hardened Portions

Figure 3A:
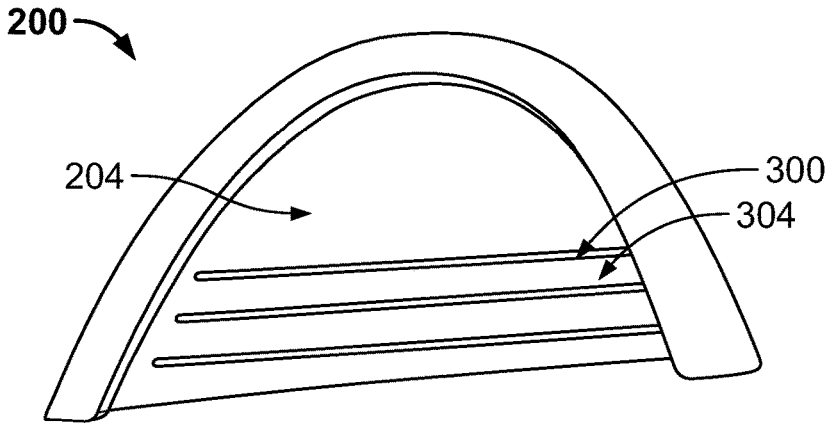
FIG. 3A is a bottom view of the safety toe cap of FIG. 2A.
Figure 3B:
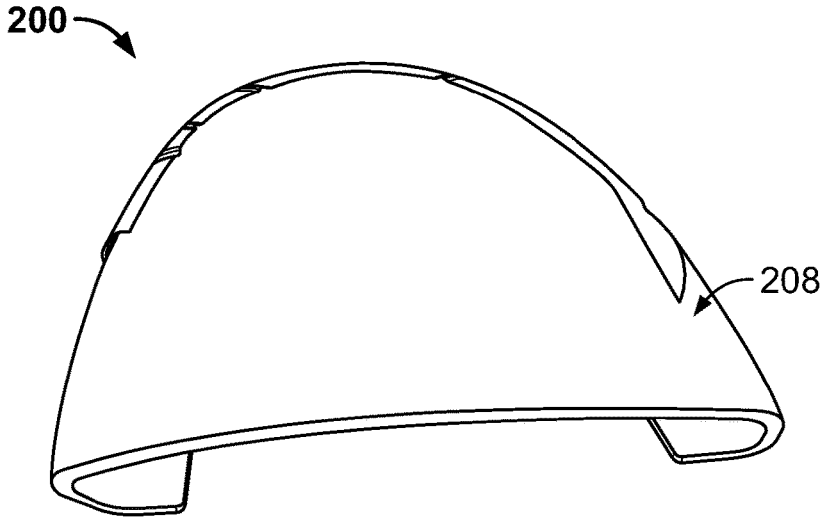
FIG. 3B is a top view of the safety toe cap of FIG. 2A.
Figure 3C:
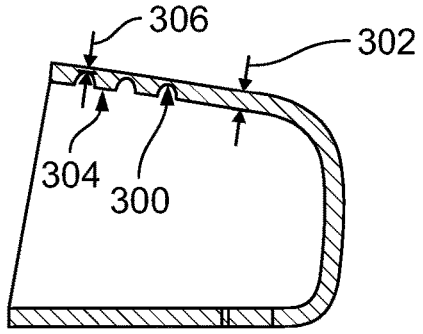
FIG. 3C is a sectional view of the safety toe-cap of FIG. 2A along the sectional line A-A.

As shown in FIGS. 3A-3C, safety toe cap 200 includes one or more strain hardened portions 300. Each strain hardened portion 300 may be formed by compression in a mold or punch designed to subject certain portions to greater compression than the surrounding areas, in order to strain harden these portions. The resulting strain hardened portion 300 has a greater yield strength and hardness than adjacent regions 304 which are not strain hardened and may provide reinforcement to the structure of safety toe cap 200, allowing for sufficient resistance to deformation under impact and protection of a user's toes with a significant reduction in thickness and weight of the safety toe cap 200.

Method of Manufacturing a Protective Toe Cap

Figure 10:
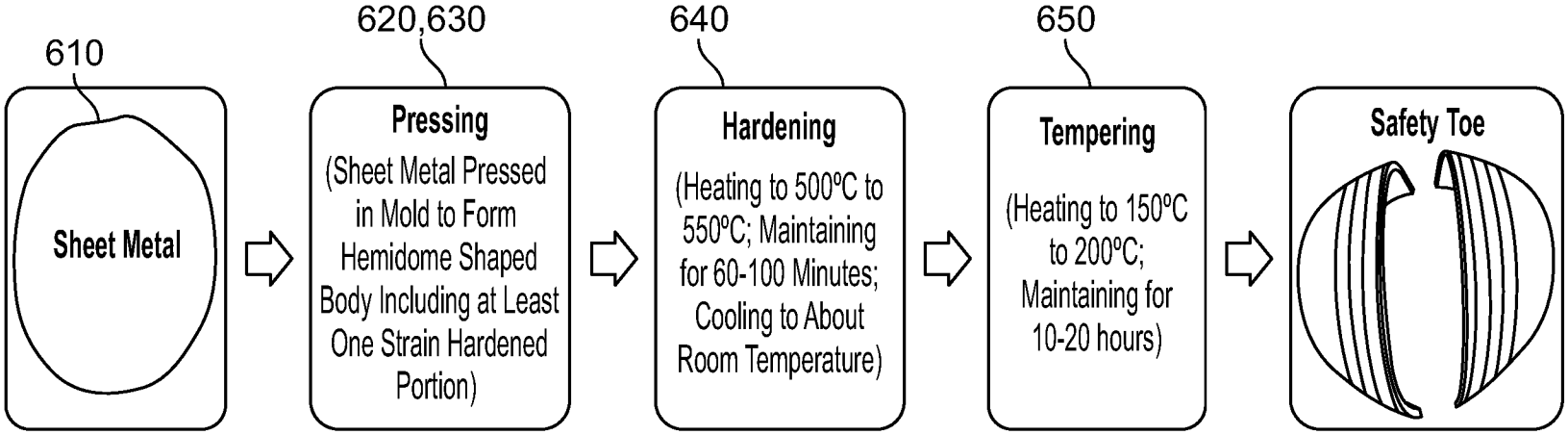
FIG. 10 is a flow diagram of a process for producing a safety toe cap according to the present technology.

According to an aspect of the disclosure, FIG. 10 illustrates a flow chart for a method 600 to manufacture a protective toe cap. Method 600 includes a step 610 of providing a sheet of metal and a step 620 of providing a mold having first and second pressing surfaces, wherein at least one of the first and second pressing surfaces includes a protrusion. Method 600 further includes a step 630 of pressing the sheet of metal between the first and second pressing surfaces to produce a hemi-dome shaped body including at least one strain hardened portion formed by the protrusion and a step 640 of hardening the hemi-dome shaped body by heating to a first temperature within a range of about 500° C. to about 550° C. and maintaining the hemi-dome shaped body at the first temperature for a first period of 60 to 100 minutes to produce a hardened hemi-dome shaped body. Method 600 may further optionally include a step 650 of tempering the hardened hemi-dome shaped body by heating to a second temperature within a range of about 150° C. to about 200° C. and maintaining the hardened hemi-dome shaped body at the second temperature for a second period of 10 to 20 hours to produce the protective toe cap. These steps are described in further detail below.

Figure 11:
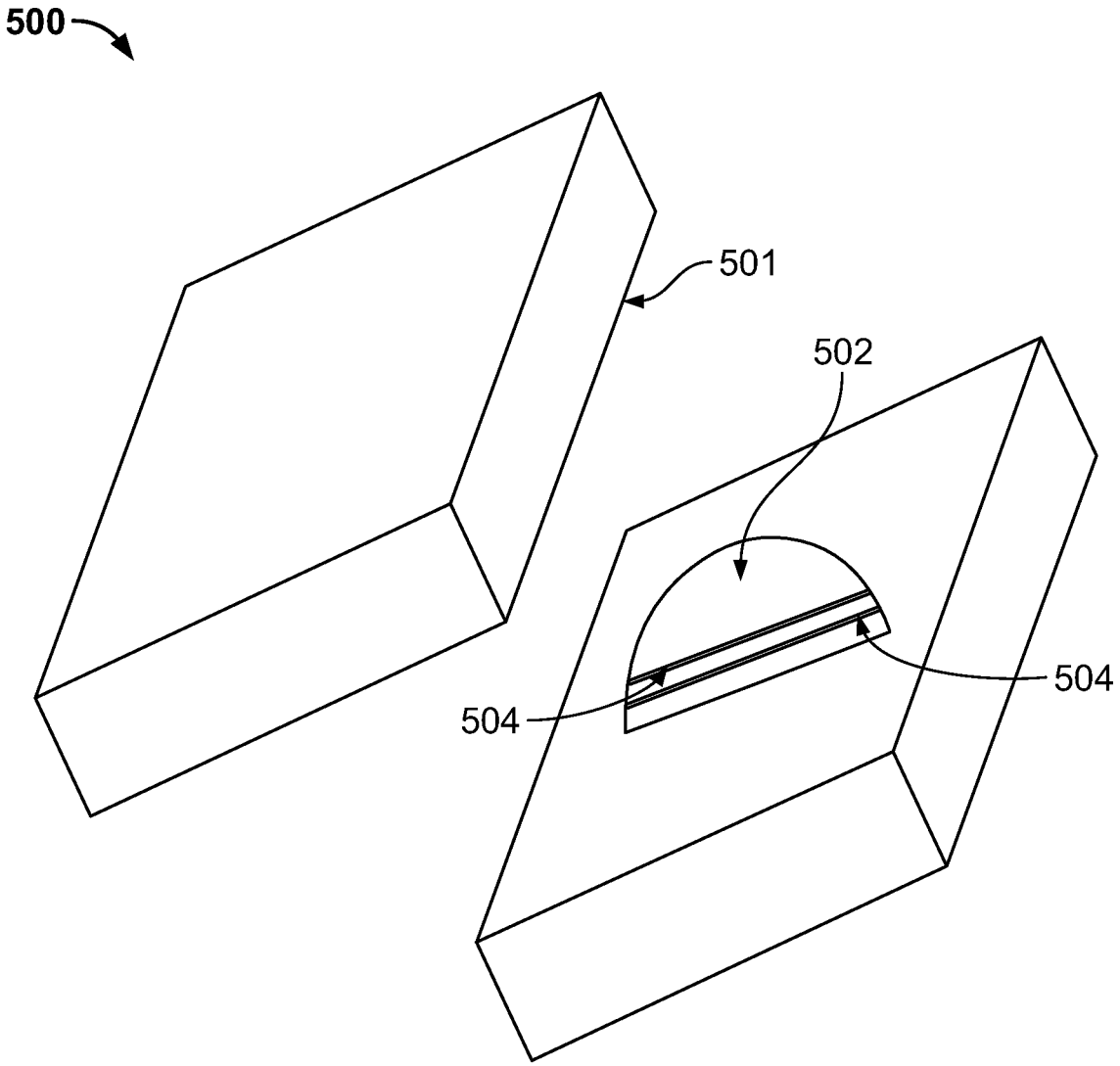
FIG. 11 is a schematic diagram of a mold for producing a safety toe cap according to the present technology.

In particular, as depicted in FIG. 11, safety toe cap 200 may be formed by pressing a sheet (not shown) of a suitable material, such as an aluminum alloy, in a mold or punch 500, illustrated schematically. In an exemplary embodiment, the punch 500 may have two opposing pressing surfaces 501, 502. The first pressing surface 501 may be configured to press one of the inner surface 204 and the outer surface 208 of safety toe cap 200 and the second, opposing pressing surface 502 may be configured to press the other of the inner surface 204 and outer surface 208. The first and/or the second pressing surfaces 501, 502 of the mold may have protrusions, ridges, or projections 504, in areas which correspond to the areas of safety toe cap 200 which are desired to be strain hardened. Accordingly, when the sheet of material is pressed in the mold 500 in order to shape it into safety toe cap 200, the protrusions 504 of the mold 500 will apply a greater level of compression to portions of the safety toe cap 200, thereby forming strain hardened portions 300. In some aspects, the pressing is conducted at about room temperature or below.

In some embodiments, as represented in FIG. 10, after pressing in the mold, safety toe cap 200 may be subjected to further processing, including a hardening process followed by a tempering process. In particular, safety toe cap 200 may be hardened by heating to within the range of about 500° C. to about 550° C., more preferably about 500° C. to about 525° C., and maintaining that temperature for a period of 60 to 100 minutes, more preferably 70 to 90 minutes, before cooling to about room temperature or below. Subsequently, safety toe cap 200 may be tempered by heating to within the range of about 150° C. to about 200° C., more preferably about 160° C. to about 180° C., and maintaining that temperature for a period of 10 to 20 hours, more preferably 15 to 20 hours.

Hardening and tempering according to these process relieves stresses created in the material of safety toe cap 200 during pressing. In particular, since the material of safety toe cap 200 is shaped from a flat sheet into a hemi-dome shape, the required bending creates a high amount of latent stress in the material. If hardening and tempering are not performed according to the presently disclosed processes in order to relieve this stress, the toe cap 200 will lack the strength and material properties needed to satisfy safety standards.

Figure 4A:
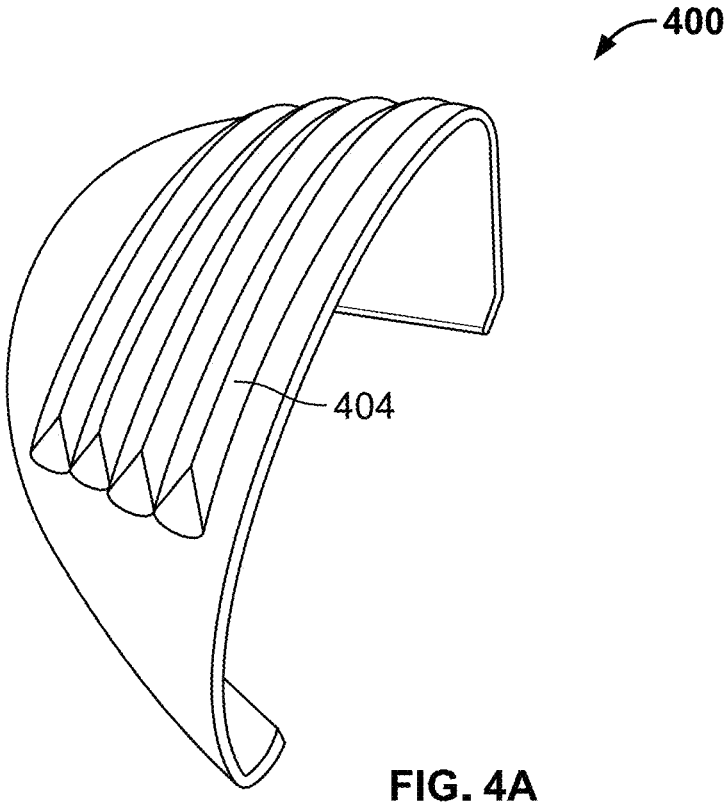
FIG. 4A (Prior Art)
FIG. 4A is a perspective view of a safety toe cap according to the prior art.
Figure 4B:
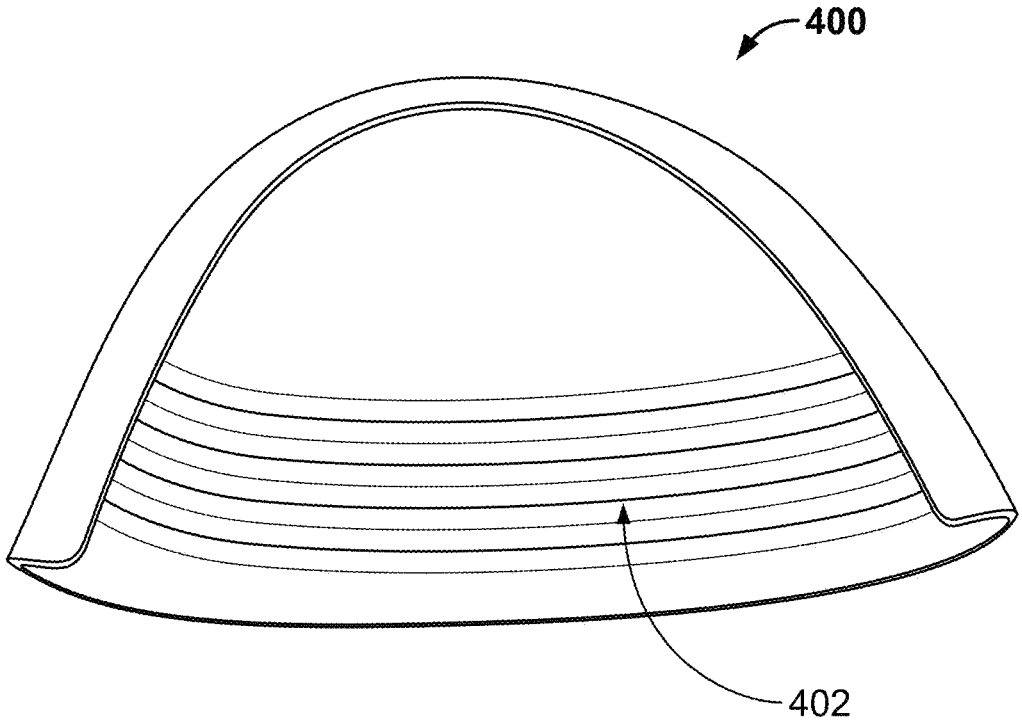
FIG. 4B (Prior Art)
FIG. 4B is a bottom view of the safety toe cap of FIG. 4A.

Strain hardened portions 300 of the present technology may have a thickness 306 which is smaller than the thickness 302 of adjacent areas 304 which are not strain hardened. For example, a strain hardened portion 300 may have a thickness 306 which is smaller than the thickness 302 of the rest of toe cap 200 by 0.2 mm to 1.0 mm, or preferably 0.2 mm to 0.5 mm. The strain hardened portion 300 of the present technology may form a depression in one of either the inner 204 or outer 208 surfaces of safety toe cap 200, as shown in FIG. 3A. However, the strain hardened portion 300 of the present technology does not form a corresponding protrusion on the opposing surface of toe cap 200, as shown in FIGS. 3B and 3C. For example, when a strain hardened portion 300 is formed as a depression in the inner surface 204 of toe cap 200, as shown in FIG. 3A, the outer surface 208 may remain substantially flat and smooth, as shown in FIG. 3B. In contrast, as shown in FIGS. 4A-4B, toe caps 400 of the prior art may include depressions 402 in one surface which have corresponding ridges or protrusions 404 in the opposing surface. Such structures may be formed by a bending process, in contrast to the compression process of the present technology. Unlike the prior art structure, the structure of the present technology may provide a toe cap 200 with a more uniform, flat outer or inner surface which may lie flat against an upper and/or inner lining of an article of footwear. In addition, the structure of the present technology provides strain hardened portions of material having improved material properties such as increased yield strength, hardness, and density. In contrast, the prior art structure produced by bending does not provide any areas of increased material properties.

The strain hardened portions 300 may also have increased hardness in relation to adjacent portions 304 of safety toe cap 200. For example, the hardness of the strain hardened portion 300 may be greater than that of adjacent portions 304 of the safety toe cap 200 by about 2% to about 4% and more preferably about 3% to about 4%. In addition, the strain hardened portions 300 may also have increased yield strength in relation to adjacent portions 304 of safety toe cap 200. For example, the yield strength of the strain hardened portion 300 may be greater than that of adjacent portions 304 of the safety toe cap 200 by about 0% to about 3%, or more preferably about 1% to about 2%.

In some aspects, the strain hardened portions 300 may be formed as continuous lines or channels in a surface of safety toe cap 200. Such channels may be substantially linear, or may form various different patterns or shapes, such as curved lines, sinusoidal or wavy lines, or zig-zag lines. In some embodiments, the strain hardened portions 300 may be provided in a configuration capable of strengthening a portion of the toe cap 200 which is structurally weaker than adjacent portions. Additionally or alternatively, the strain hardened portions 300 may be provided in a location which tends to be subjected to greater stresses during use or during impact from above. Accordingly, the strain hardened portions 300 may be provided in a configuration which reinforces these locations and dissipates stress to underutilized and understressed areas of the structure of the toe cap 200.

As shown in FIGS. 3A-3B, in a preferred embodiment, one or more strain hardened portions 300 may be formed as depressions in the inner surface 204 of toe cap 200. In such an embodiment, the outer surface of the toe cap 208 may remain substantially flat and smooth, as shown in FIG. 3B. Each of the strain hardened portions 300 may be substantially linear in shape and forms a channel in the inner surface 204 of toe cap 200, running from a medial side 216 to a lateral side 218 of toe cap 200. In an embodiment, two to five, more preferably two to four, or most preferably three strain hardened portions are provided, with each of the strain hardened portions being generally parallel to one another. In some embodiments, the one or more strain hardened portions 300 may be provided nearer a midfoot side 214 of toe cap 200 than a forefoot side 212. During use, the midfoot portion of toe cap 200 is more likely to be subjected to significant stresses upon impact from objects dropped from above. Accordingly, providing one or more strain hardened portions 300 near the midfoot side may reinforce this area and allow for dissipation of stress to the forefoot region of toe cap 200, which is generally subjected to less stress from downward impact.

Figure 5A:
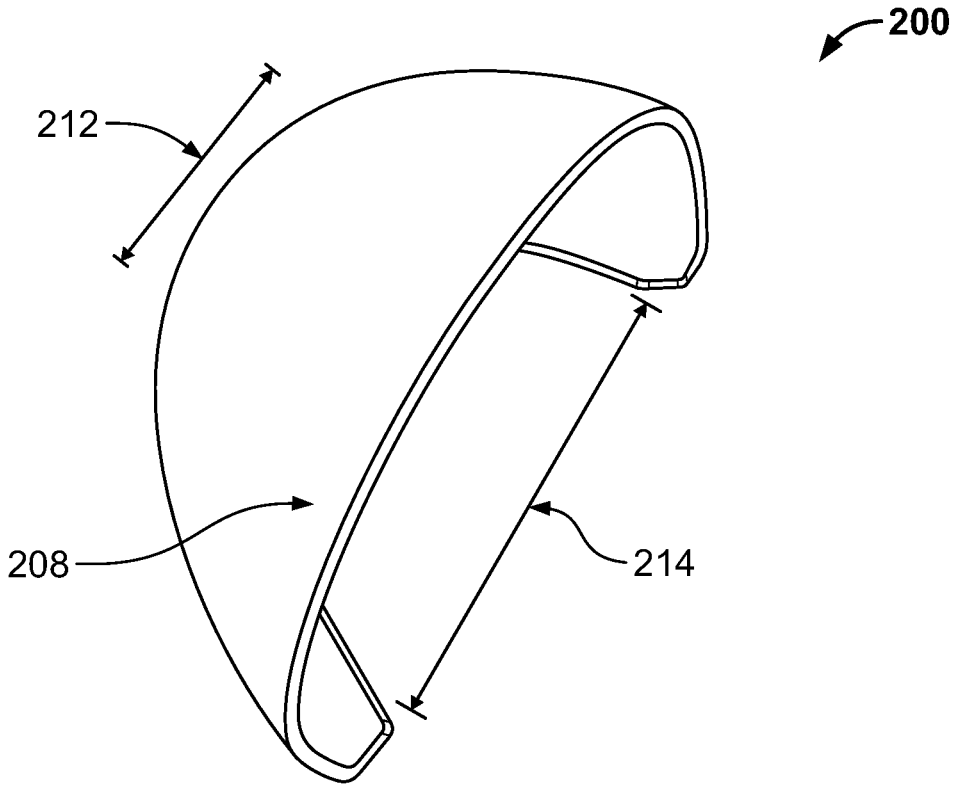
FIG. 5A is a perspective view of a safety toe cap according to an embodiment of the present technology.
Figure 5B:
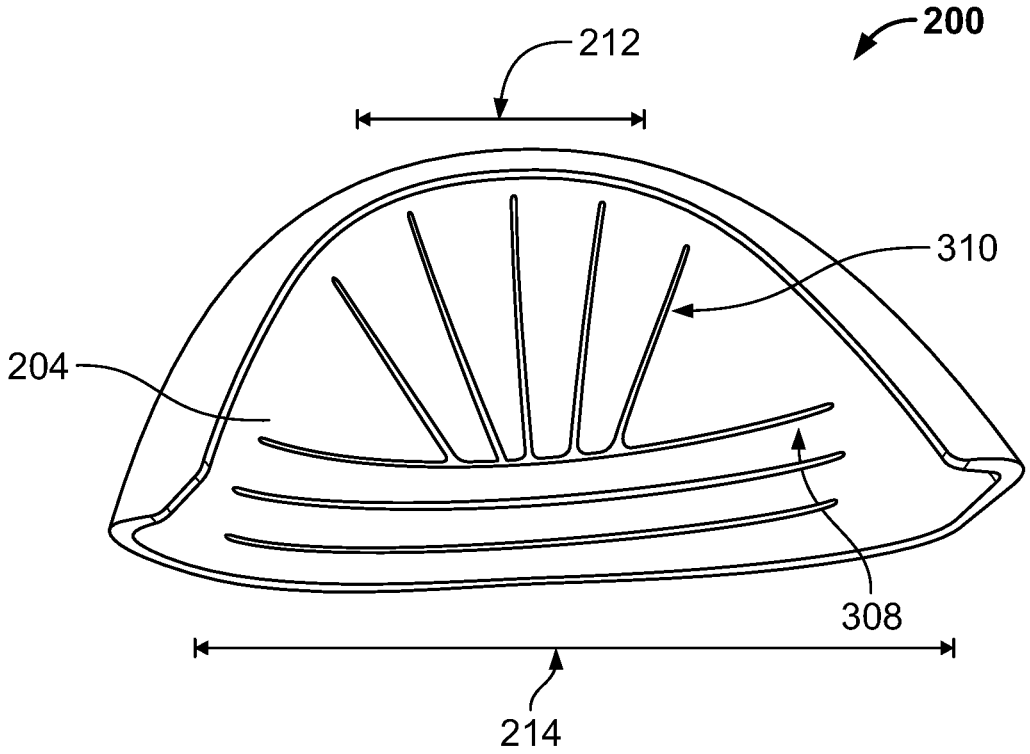
FIG. 5B is a bottom view of the safety toe cap of FIG. 5A.

In some embodiments, as shown in FIGS. 5A-5B, in addition to medial-lateral running strain hardened portions 308, safety toe cap 200 may also include strain hardened portions 310 running in a direction from a midfoot side 214 of toe cap 200 to a forefoot side 212 of toe cap 200. These midfoot-forefoot strain hardened portions 310 may be substantially linear in shape or may be curved, zig-zagged, etc. In some embodiments the midfoot-forefoot strain hardened portions 310 may be disposed nearer a forefoot side 212 of toe cap 200 than a midfoot side 214. Thus, these strain hardened portions may cooperate with medial-lateral strain hardened portions 308 to provide further reinforcement of the forefoot region in addition to strengthening of the midfoot region.

Figure 6A:
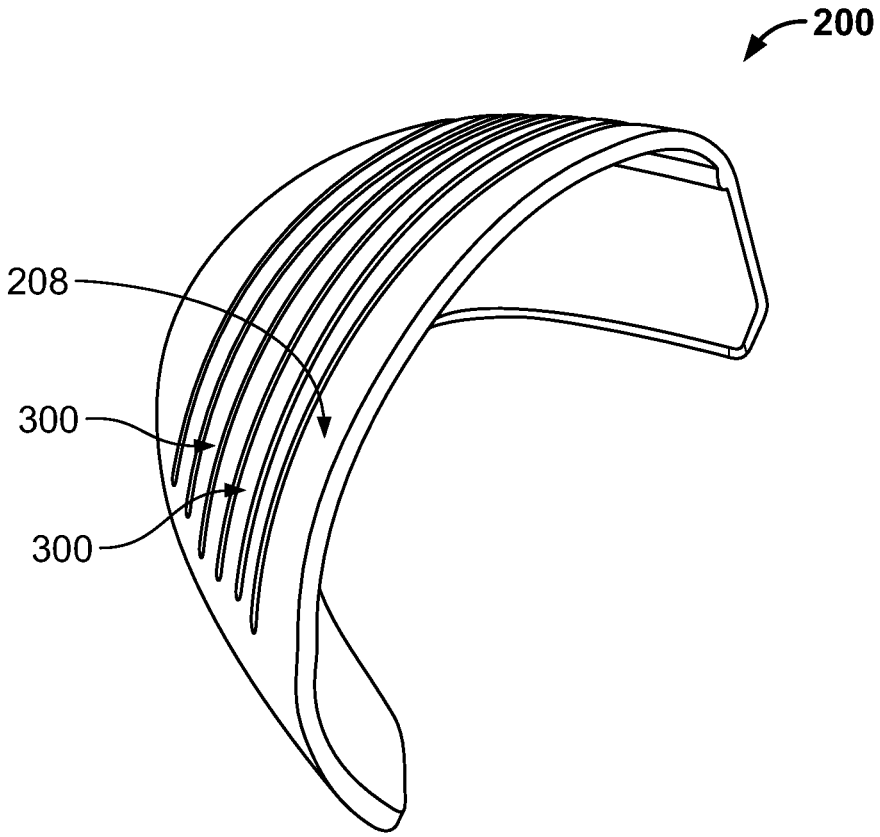
FIG. 6A is a perspective view of a safety toe cap according to an embodiment of the present technology.
Figure 6B:
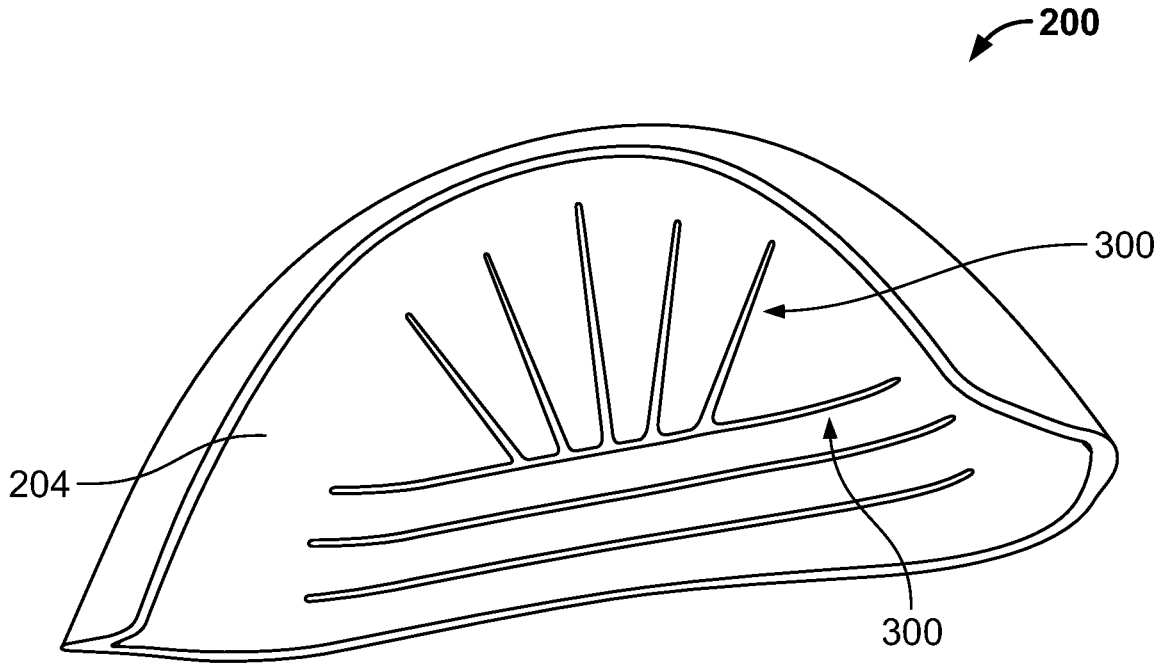
FIG. 6B is a bottom view of the safety toe cap of FIG. 6A.

Further, in some embodiments, as shown in FIGS. 6A-6B, safety toe cap 200 may be provided with strain hardened portions 300 on both the inner 204 and outer 208 surfaces. In particular, safety toe cap 200 may comprise strain hardened portions 300 formed as depressions on the inner surface 204 of toe cap 200, as well as strain hardened portions 300 formed as depressions on the outer surface 208 of toe cap 200. In such an embodiment, these strain hardened portions 300 would be formed by a mold in which both the first and second pressing surfaces have protrusions configured to create strain hardened portions. Such an embodiment differs from toe caps 400 of the prior art in that each depression on the inner surface 204 of the toe cap 200 may not have a corresponding protrusion on the outer surface 208 of the toe cap 200 and vice versa. In a bent toe cap 400 of the prior art, such as the one shown in FIGS. 4A-4B, each depression on a surface of toe cap 400 corresponds to a protrusion on the opposing surface. In contrast, the toe cap 200 of FIGS. 6A-6B may have depressions formed independently on both the inner 204 and the outer 208 surfaces by protrusions on the corresponding pressing surface of a mold. These depressions do not necessarily have a corresponding protrusion on the opposing side of the toe cap 200.

Figure 7A:
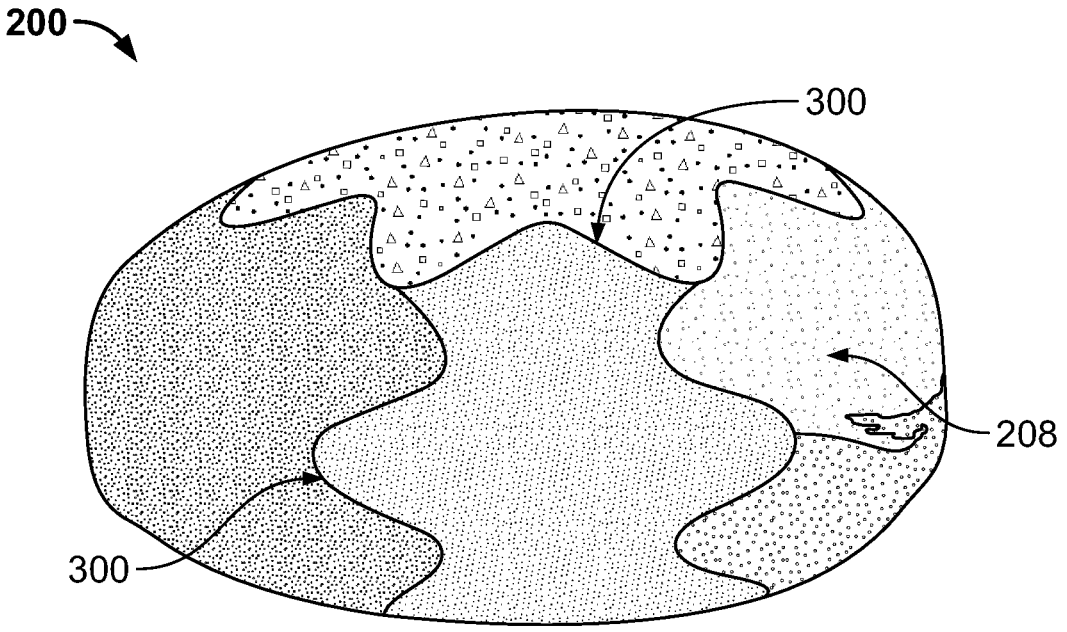
FIG. 7A is a view of a safety toe cap according to an embodiment of the present technology, in a forefoot to midfoot direction, illustrating an arrangement of strain-hardened regions.
Figure 7B:
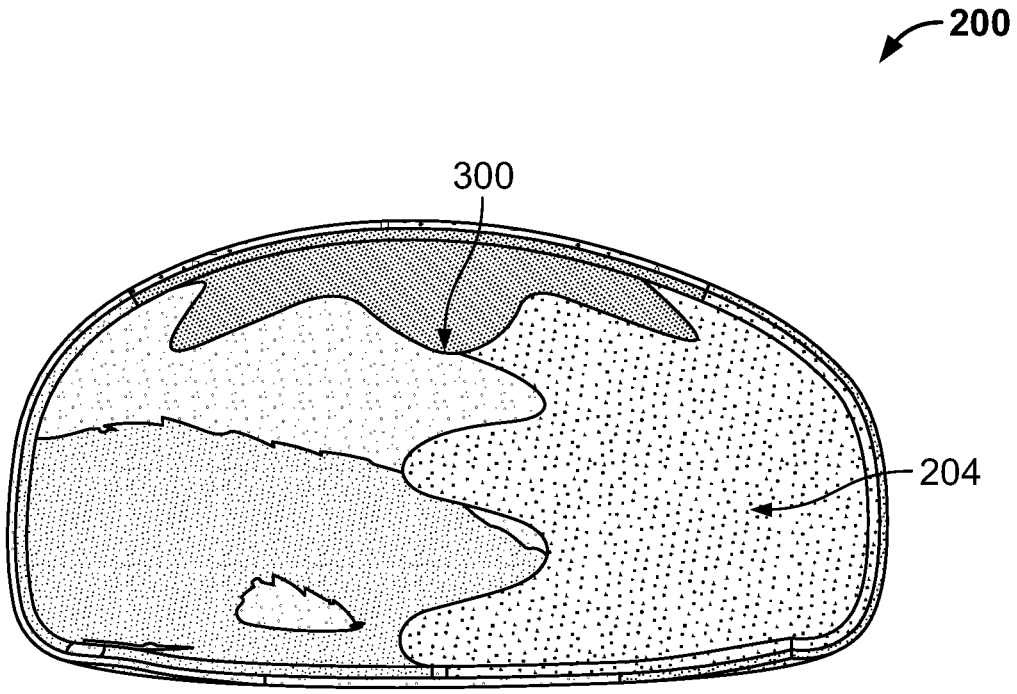
FIG. 7B is a view of the safety toe cap of FIG. 7A, in a midfoot to forefoot direction.
Figure 8:
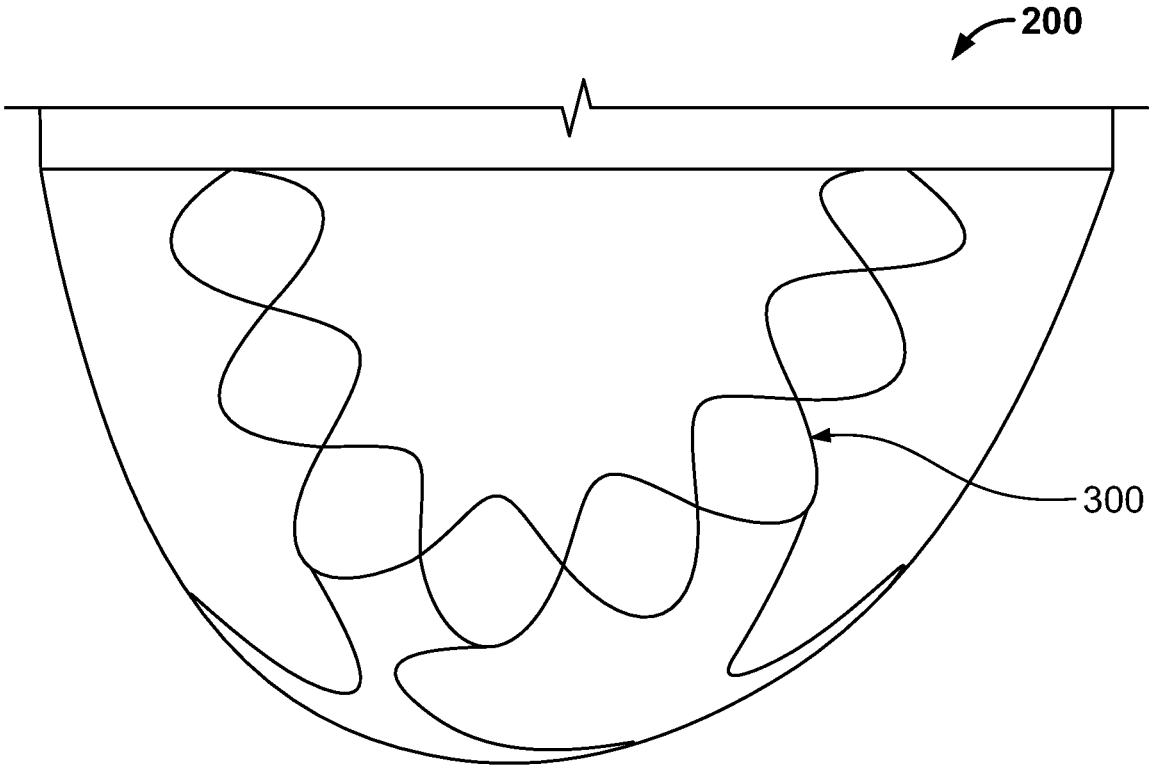
FIG. 8 is a schematic top view of a safety toe cap according to an embodiment of the present technology.
Figure 9:
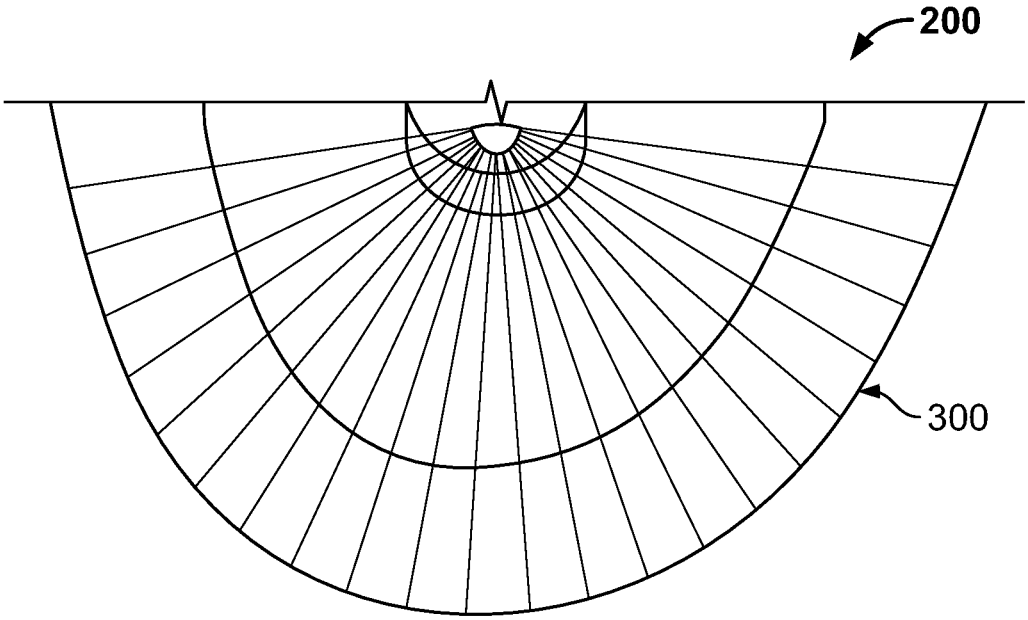
FIG. 9 is a schematic top view of a safety toe cap according to an embodiment of the present technology.

In addition, the one or more strain hardened portions 300 may be formed in various alternative configurations designed to reinforce safety toe cap 200 against impact. For example, as shown in FIGS. 7A-7B and 8, strain hardened portions 300 may be formed in the inner 204 and/or outer 208 surfaces as continuous wavy or sinusoidal lines placed to strengthen both a midfoot and forefoot region of safety toe cap 200. Alternatively, as exemplified in FIG. 9, strain hardened portions 300 may be formed as linear channels extending radially from a point in the midfoot region of safety toe cap 200 to multiple endpoints along the forefoot side of safety toe cap 200. Various other configurations and placements of strain hardened portions are also contemplated.

Protective Footwear

A safety toe cap 200 according to the present technology may be provided as a separate protective device or may be incorporated into an article of footwear 100, as depicted in FIG. 1. In the case in which the safety toe cap 200 is incorporated into an article of footwear or shoe 100, the outer surface 208 of the toe cap 200 may be shaped and sized to fit within and lie flush with an inside surface of an upper 102 of the shoe.

Toe cap 200 can be incorporated into a variety of different types of footwear, to allow for safety and protection of the toes of a user from impacts and falling objects while also providing lightweight footwear with a slim, streamlined profile.

Referring back to FIG. 1, footwear 100 incorporating toe cap 200 may include all standard aspects of normal footwear, including but not limited to an outsole 104, an upper 102 attached to outsole 104, forefoot 106, arch 108, and heel 110 regions, and a tongue 112 forming part of upper 102. Although other common footwear components are not described in detail herein, footwear 100 may include such components as is apparent in the figures (e.g., laces, etc.).

Footwear 100 according to the present technology also includes a toe cap 200 embedded within its forefoot region 106. Toe cap 200 may be incorporated into the toe region of footwear 100 and may be arranged with its lip 220 adjacent outsole 104, so that its outer surface 208 sits flush against upper 102. Inner surface 204 of toe cap 200 may be covered by a lining, mesh, or other fabric or padding disposed within upper 102. Toe cap 200 may therefore provide protection for a user's toes against, for example, a falling object.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A method of manufacturing a protective toe cap, comprising:

providing a sheet of metal;

providing a mold having first and second pressing surfaces, wherein at least one of the first and second pressing surfaces includes a protrusion;

pressing the sheet of metal between the first and second pressing surfaces to produce a hemi-dome shaped body including at least one strain hardened portion formed by the protrusion;

hardening the hemi-dome shaped body by heating to a first temperature within a range of about 500° C. to about 550° C. and maintaining the hemi-dome shaped body at the first temperature for a first period of 60 to 100 minutes to produce a hardened hemi-dome shaped body; and tempering the hardened hemi-dome shaped body by heating to a second temperature within a range of about 150° C. to about 200° C. and maintaining the hardened hemi-dome shaped body at the second temperature for a second period of 10 to 20 hours to produce the protective toe cap.

2. The method of claim 1, wherein the sheet of metal comprises one or more of aluminum, steel, magnesium, or titanium, or an alloy thereof.

3. The method of claim 2, wherein the pressing is conducted at a temperature of no more than about room temperature.

4. The method of claim 1, wherein the pressing is conducted at a temperature of no more than about room temperature.

5. The method of claim 1, wherein the providing a mold with first and second pressing surfaces further comprises providing the mold with first and second pressing surfaces having one or more projections that correspond to an area of the protective toe cap having the at least one strain hardened portion.

6. The method of claim 1, wherein the providing a mold with first and second pressing surfaces further comprises providing the mold with first and second pressing surfaces having one or more ridges that correspond to areas of the protective toe cap with the at least one strain hardened portion.

7. The method of claim 1, wherein a thickness of the at least one strain hardened portion of the tempered and hardened hemi-dome shaped body producing the protective toe cap is less than a thickness of a non-strain hardened portion of the tempered and hardened hemi-dome shaped body producing the protective toe cap by 0.2 mm to 0.5 mm.

8. The method of claim 1, wherein a thickness of the at least one strain hardened portion of the tempered and hardened hemi-dome shaped body producing the protective toe cap is less than a thickness of a non-strain hardened portion of the tempered and hardened hemi-dome shaped body producing the protective toe cap by 0.2 mm to 1.0 mm.

9. The method of claim 1, wherein the at least one strain hardened portion of the tempered and hardened hemi-dome shaped body producing the protective toe cap has a greater hardness than adjacent portions of the tempered and hardened hemi-dome shaped body producing the protective toe cap.

* * * * *